US007415226B2

(12) United States Patent
Sakai et al.

(10) Patent No.: US 7,415,226 B2
(45) Date of Patent: Aug. 19, 2008

(54) IMAGE FORMATION APPARATUS AND IMAGE FORMATION METHOD

(75) Inventors: Akihiko Sakai, Abiko (JP); Shigeo Hata, Toride (JP); Yasuyuki Aiko, Toride (JP); Katsuhide Koga, Moriya (JP); Takashi Nagaya, Moriya (JP); Takashi Birumachi, Kashiwa (JP); Shingo Kitamura, Abiko (JP)

(73) Assignee: Canon Kabushiki Kaisha (JP)

( * ) Notice: Subject to any disclaimer, the term of this patent is extended or adjusted under 35 U.S.C. 154(b) by 489 days.

(21) Appl. No.: 11/297,794

(22) Filed: Dec. 8, 2005

(65) Prior Publication Data

US 2006/0153588 A1 Jul. 13, 2006

(30) Foreign Application Priority Data

Dec. 8, 2004 (JP) ..... 2004-355884

(51) Int. Cl.
*G03G 15/22* (2006.01)
*G03G 15/00* (2006.01)
*G03G 13/04* (2006.01)

(52) U.S. Cl. ..... 399/130; 399/38; 347/132

(58) Field of Classification Search ..... 347/132; 399/110, 36, 130, 138, 38; 310/314; 715/740; 396/52; 348/126
See application file for complete search history.

(56) References Cited

U.S. PATENT DOCUMENTS 6,060,813 A * 5/2000 Nowak ..... 310/314
6,831,665 B2 * 12/2004 Tsuda et al. ..... 715/740
7,286,776 B2 * 10/2007 Morita et al. ..... 399/36
2007/0098381 A1 * 5/2007 Oshima ..... 396/52
2007/0291114 A1 * 12/2007 Oshima ..... 348/126

FOREIGN PATENT DOCUMENTS

JP 58-121067 A 7/1983
JP 1-152661 A 6/1989
JP 11-52661 A 2/1999

* cited by examiner

*Primary Examiner*—Stephen D. Meier
*Assistant Examiner*—Carlos A Martinez, Jr.
(74) *Attorney, Agent, or Firm*—Rossi, Kimms & McDowell, LLP

(57) ABSTRACT

In an image formation method of an image formation apparatus for correcting uneven image formation on the basis of vibration property information corresponding to an operation sequence in image formation, vibration property information corresponding to a plurality of operation sequences are stored in a storage device. The uneven image formation is corrected on the basis of vibration property information corresponding to an operation sequence selected from the storage device. Vibration property information generated by driving a movable member is measured when the selected operation sequence is being executed while correcting the uneven image formation. It is determined whether the measured vibration property information is similar to the vibration property information selected from the storage device. The vibration property information stored in the storage device is rewrite-controlled in accordance with the measurement result or the determination result.

15 Claims, 12 Drawing Sheets

FIG. 8A

| | | | M | Y | C | K |
|---|---|---|---|---|---|---|
| CASSETTE 1 | LARGE | SINGLE -SIDED | profile(M)01 | profile(Y)01 | profile(C)01 | profile(K)01 |
| | | DOUBLE -SIDED | profile(M)11 | profile(Y)11 | profile(C)11 | profile(K)11 |
| | SMALL | SINGLE -SIDED | profile(M)21 | profile(Y)21 | profile(C)21 | profile(K)21 |
| | | DOUBLE -SIDED | profile(M)31 | profile(Y)31 | profile(C)31 | profile(K)31 |
| CASSETTE 2 | LARGE | SINGLE -SIDED | profile(M)41 | profile(Y)41 | profile(C)41 | profile(K)41 |
| | | | ..... | ..... | ..... | ..... |

FIG. 8B

| | | | M | Y | C | K |
|---|---|---|---|---|---|---|
| | | | | | | |
| CASSETTE 3 | LARGE | SINGLE -SIDED | profile(M)51-1<br>profile(M)51-2<br>profile(M)51-3 | .....<br>.....<br>..... | .....<br>.....<br>..... | .....<br>.....<br>..... |
| | | | | | | |

IMAGE FORMATION APPARATUS AND IMAGE FORMATION METHOD

FIELD OF THE INVENTION

The present invention relates to an image formation technique which enables image formation with an excellent image quality and productivity.

BACKGROUND OF THE INVENTION

In electrophotographic image formation apparatuses (to be also simply referred to as "image formation apparatuses" hereinafter) which transfer a toner latent image on a transfer member to a printing sheet medium represented by normal paper and thermally fix the image to form a copy image, the desire to improve the image quality and productivity is growing more and more in recent years. To improve the productivity, the image formation velocity must be increased. More specifically, the driving velocity of movable members included in an image formation apparatus needs to be increased.

However, when the movable members are driven at a high velocity, vibration in driving or stopping them increases in geometric progression. The possibility of the vibration having an adverse effect on the image formation operation also increases.

Especially, when an exposure unit to electrostatically print electrostatic image information corresponding to image information uses laser irradiation by a polygon scanner, the irradiation accuracy of the laser beam on a charged unit such as a photosensitive drum is influenced by the above-described vibration of the movable members. For this reason, the vibration may directly result in uneven exposure accuracy and poor image quality.

If the movable members must inevitably be driven at a higher velocity to improve the productivity, the vibration generated by their operation will also unavoidably increase to some extent.

In a conventional image generation apparatus, to minimize uneven exposure accuracy by a vibration factor generated from movable members, the vibration property information (to be referred to as a "profile" hereinafter) of vibration generated by the operation of the movable members during image formation is measured and stored in advance. In actual image formation, vibration during image formation is predicted on the basis of the information. Exposure control to prevent any uneven exposure accuracy is executed, thereby limiting occurrence of uneven exposure accuracy.

The above-described prior art is disclosed in, e.g., Japanese Patent Laid-Open No. 58-121067.

In another method of minimizing uneven exposure accuracy by a vibration factor generated from movable members, image write by the laser is inhibited during the operation of moving the developing unit to prepare for development. However, if the need for a higher velocity grows, a problem may be posed in the productivity.

The above-described prior art is disclosed in, e.g., Japanese Patent Laid-Open No. 11-52661.

The vibration during image formation can be generated by various factors. More specifically, since the movement of the movable members changes depending on the operation sequence of image formation, it is not enough to use only one profile for all image formation operations.

In, e.g., a color image formation apparatus using a rotary developing unit, the rotation operation of the rotary developing unit for color switching is executed in parallel to the exposure operation for each color but in a different sequence. Hence, the profile also changes in each operation. Additionally, if vibration generated by the driving motor during the printing sheet medium convey operation which is executed simultaneously with image formation is to be taken into consideration, the profile may also change depending on the position of the paper feed cassette or the size of the printing sheet medium.

In such situations, the uneven exposure accuracy cannot be corrected by a single profile. Profiles corresponding to the respective situations must be prepared in advance.

The vibration property of a movable member can vary due to aging of the apparatus even in the same operation sequence. In this case, the vibration property of the movable members is not always the same because the state of the apparatus itself changes for a long term, although the change is not so large as that caused by the difference between the operation sequences.

For example, if the above-described rotary developing unit incorporates a toner bottle, the toner amount in the rotary developing unit always changes in accordance with the driving situation of the image formation apparatus. Since the weight of toner in the rotary developing unit constitutes a fair part of the total weight of the movable members, the change in toner weight has a nonnegligible effect on the rotation characteristic of the rotary developing unit. Hence, the rotation characteristic of the rotary developing unit varies even due to the remaining toner amount. In addition, the exposure operation does not always exhibit the same profile even when the rotary developing unit incorporates a toner bottle of the same color.

As a measure against this problem, profiles must be measured and stored in advance in various situations.

However, since the printing unit to store profiles has only a limited memory capacity, it is impossible to store profiles corresponding to all situations but only certain kinds of representative patterns can be stored. Hence, the uneven exposure accuracy cannot be corrected sufficiently because correction by the representative patterns has limitation.

SUMMARY OF THE INVENTION

The present invention has been made in consideration of the above-described situations. The profile of the vibration property of a movable member which influences the uneven exposure accuracy is generated and updated in parallel to the actual image formation operation, thereby always updating the profile reflecting the vibration property of the movable member varying over time. Additionally, in updating the profile, it is compared with a plurality of already stored profiles to determine the similarity between them. If the similarity is high, the existing profiles are updated and displayed by mutual calculation with the newly acquired profile. If the similarity is low, the new profile is separately registered and displayed.

It is an object of the present invention to provide an image formation technique capable of correcting uneven exposure accuracy by using a profile adaptive to the vibration property of a movable member which varies over time while efficiently using the memory capacity.

In order to achieve the above object, an image formation apparatus according to the present invention is characterized by mainly comprising the following arrangement.

That is, an image formation apparatus for correcting uneven image formation on the basis of vibration property information corresponding to an operation sequence in image formation, comprises:

a storage device adapted to store vibration property information corresponding to a plurality of operation sequences;

a correction device adapted to correct the uneven image formation on the basis of vibration property information corresponding to an operation sequence selected from the storage device;

a measurement device adapted to measure vibration property information generated by driving of a movable member when the selected operation sequence is being executed while the uneven image formation is corrected by the correction device; and a memory control device adapted to rewrite-control the vibration property information selected from the storage device in accordance with a measurement result of the measurement device.

An image formation apparatus for correcting uneven image formation on the basis of vibration property information corresponding to an operation sequence in image formation, comprises:

a storage device adapted to store vibration property information corresponding to a plurality of operation sequences;

a correction device adapted to correct the uneven image formation on the basis of vibration property information corresponding to an operation sequence selected from the storage device;

a measurement device adapted to measure vibration property information generated by driving of a movable member when the selected operation sequence is being executed while the uneven image formation is corrected by the correction device;

a determination device adapted to determine whether the vibration property information measured by the measurement device is similar to the vibration property information selected from the storage device; and a memory control device adapted to rewrite-control the vibration property information stored in the storage device in accordance with a determination result of the determination device.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 8A and 8B are views showing the matrices of profiles necessary as correction data for the exposure operation;

DETAILED DESCRIPTION OF THE PREFERRED EMBODIMENTS

Preferred embodiments of the present invention will now be described in detail in accordance with the accompanying drawings.

First Embodiment

Figure 2:
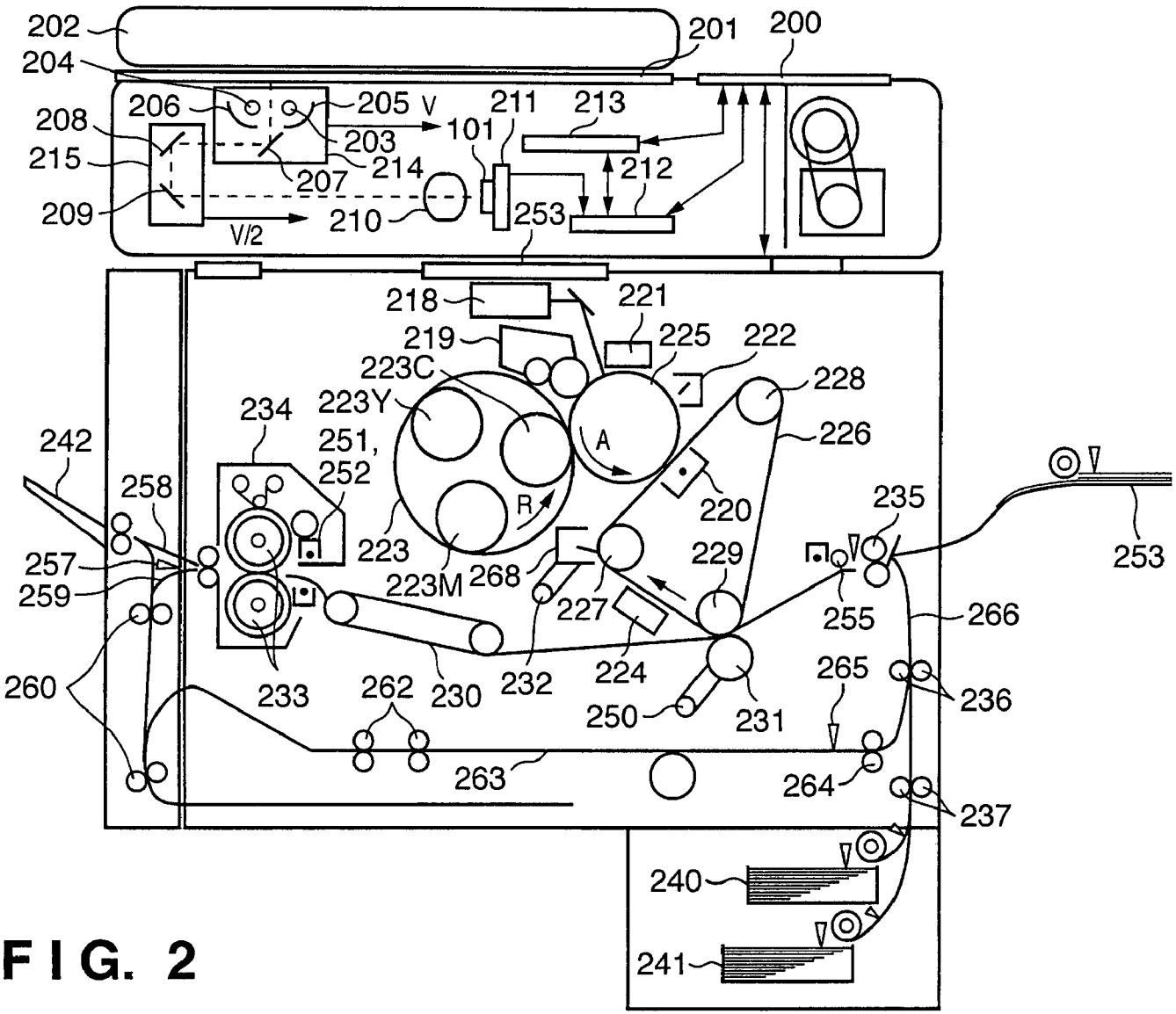
FIG. 2 is a view showing the overall arrangement of an image formation apparatus according to an embodiment of the present invention.

FIG. 2 is a view showing the overall arrangement of an image formation apparatus. Reference numeral 101 denotes a CCD; 211, a board on which the CCD 101 is mounted; 200, a control unit to control the entire image formation apparatus; 212, a digital image processing unit; 201, a document glass table (platen); 202, a document feeder (DF) (not the document feeder 202 but a mirror platen (not shown) is mounted in some arrangements); 203 and 204, light sources (halogen lamps or florescent lamps) to illuminate a document; 205 and 206, reflectors to focus light from the light sources 203 and 204 to the document; 207 to 209, mirrors; 210, a lens to focus reflected light or projected light from the document onto the CCD 101; 214, a carriage to store the halogen lamps 203 and 204, reflectors 205 and 206, and mirror 207; 215, a carriage to store the mirrors 208 and 209; and 213, an external interface (I/F) to another device. The carriage 214 mechanically moves at a velocity V, and the carriage 215 mechanically moves at a velocity V/2 in a direction perpendicular to the electrical scanning (main scanning) direction of the CCD 101, thereby scanning (sub-scanning) the entire surface of a document.

Figure 3:
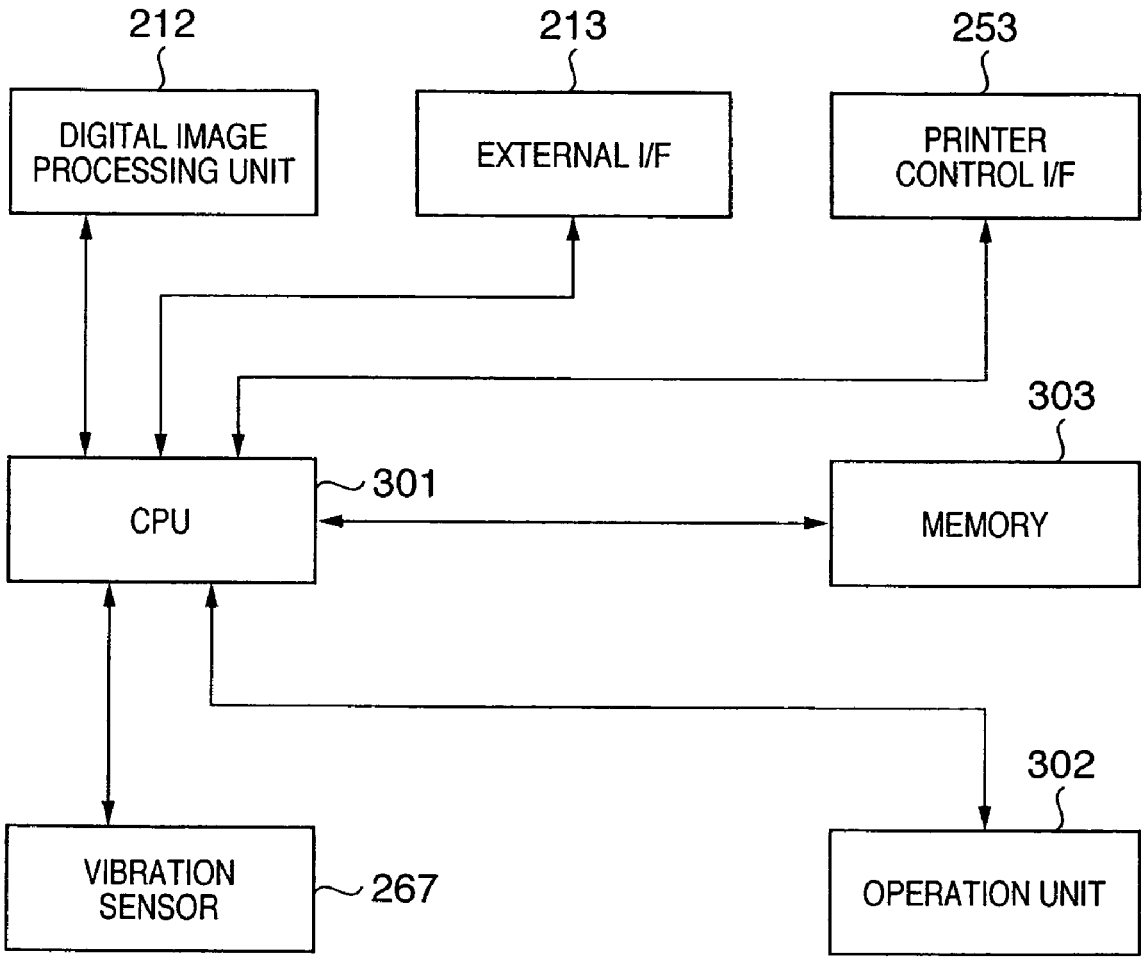
FIG. 3 is a block diagram showing the arrangement of a control unit.

As shown in FIG. 3, the control unit 200 includes a CPU 301, operation unit 302, and memory 303. The CPU 301 has interfaces (I/Fs) capable of transmitting/receiving information for control to/from the digital image processing unit 212, external interface (I/F) 213, printer control interface (I/F) 253, and vibration sensor 267.

The operation unit 302 includes a liquid crystal display device with a touch panel to input processing execution contents by the operator or notify the operator of information about processing or warning.

Figure 4:
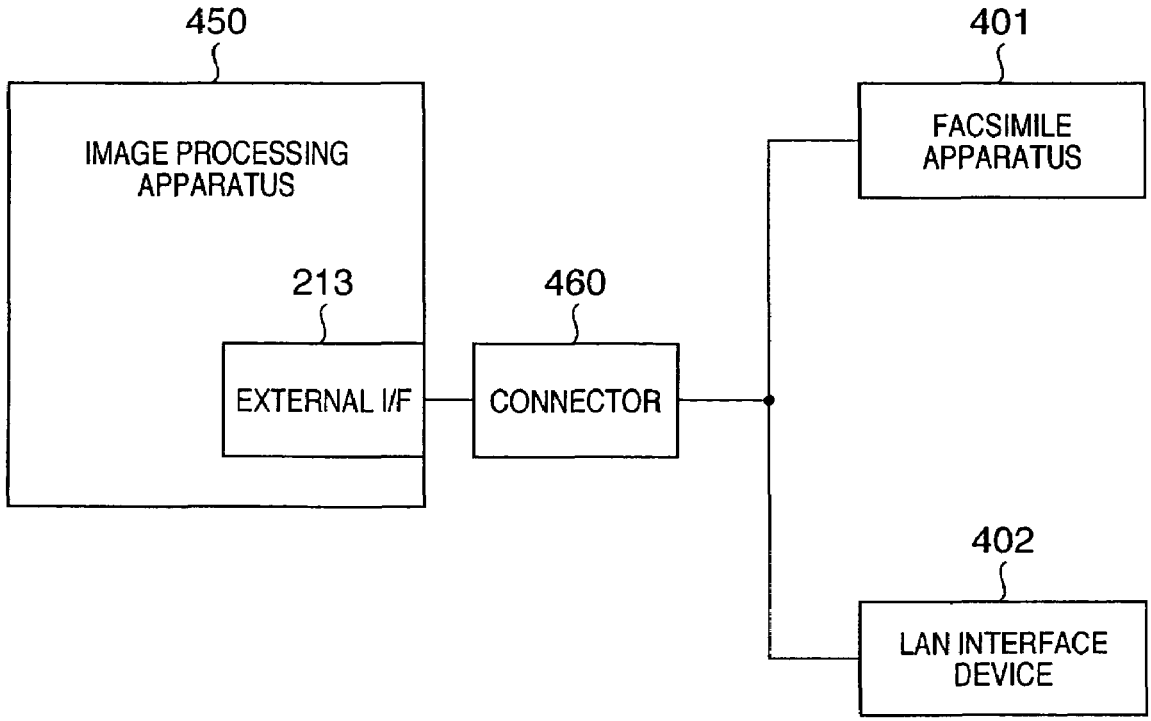
FIG. 4 is a block diagram showing the arrangement of an external interface.

The external I/F 213 is an interface to transmit/receive image information or code information to/from a device outside an image processing apparatus 450. More specifically, as shown in FIG. 4, the external I/F 213 can be connected to a facsimile apparatus 401 or LAN interface device 402 through a connector 460.

Figure 1:
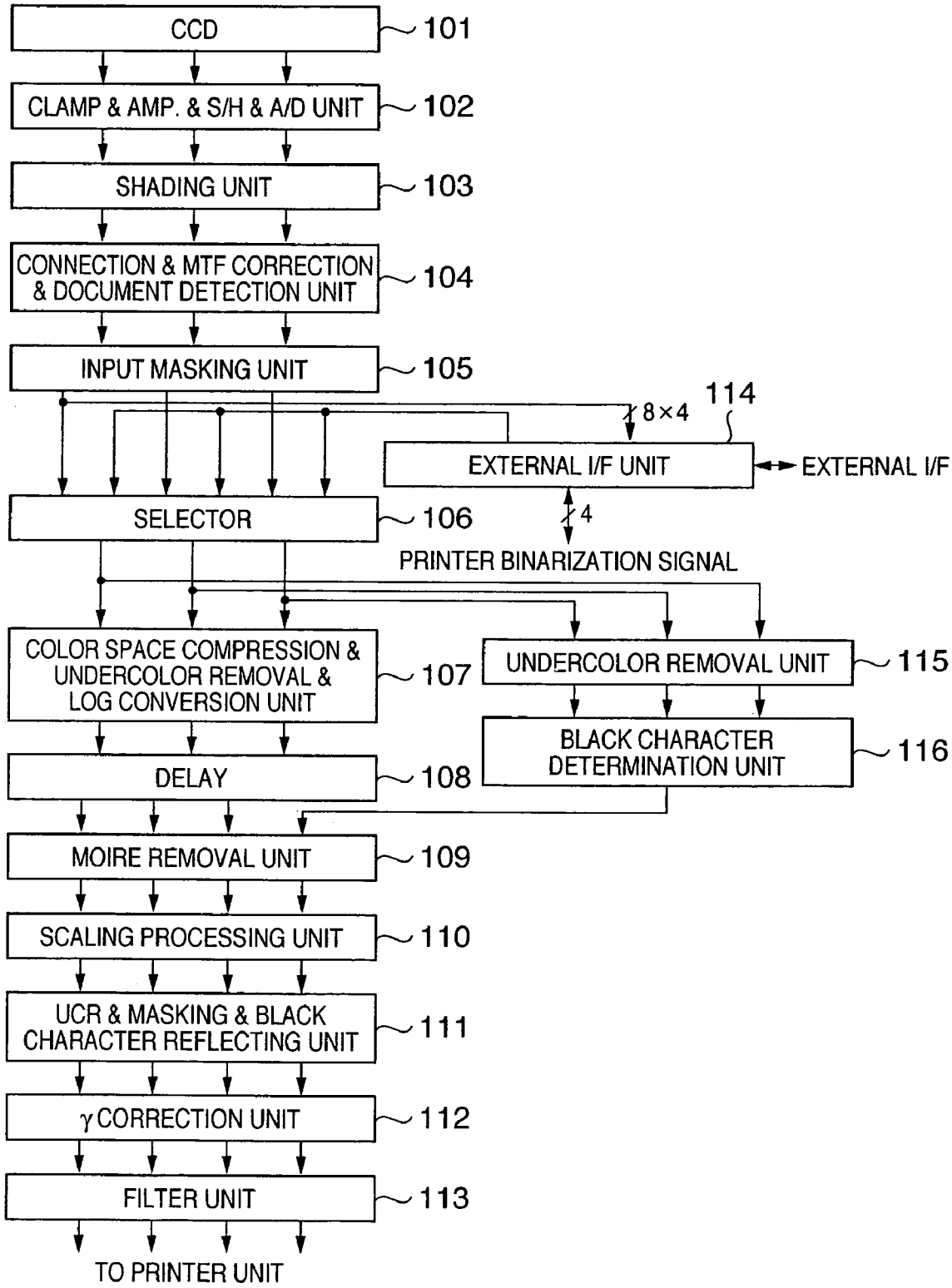
FIG. 1 is block diagram showing the detailed arrangement of a digital image processing unit.

The digital image processing unit 212 will be described next in detail. FIG. 1 is block diagram showing the detailed arrangement of the digital image processing unit 212. A document on the document glass table reflects light from the light sources 203 and 204. The reflected light is guided to the CCD 101 and converted into an electrical signal. The electrical signal (analog image signal) is input to the digital image processing unit 212 and sampled and held (S/H) by a clamp & Amp. & S/H & A/D unit 102. In the clamp & Amp. & S/H & A/D unit 102, the dark level of the analog image signal is clamped to the reference potential, and the signal is amplified to a predetermined amount and A/D-converted into, e.g., a digital signal containing 8 bits for each of R, G, and B.

The R, G, and B signals are subjected to shading correction and black correction by a shading unit 103. The corrected R. G, and B signals are input to a connection & MTF correction & document detection unit 104 to correct the reading position timing. The corrected digital signals are input to an input masking unit 105 to correct the spectral characteristic to the CCD 101 and that of the light sources 203 and 204 and reflectors 205 and 206. The outputs from the input masking unit 105 are input to a selector 106 capable doing switching to an external I/F signal. Each signal output from the selector 106 is input to a color space compression & undercolor removal & LOG conversion unit 107 and undercolor removal unit 115. The signal input to the undercolor removal unit 115 undergoes undercolor removal and is then input to a black character determination unit 116 to determine whether the document contains black characters. The black character determination unit 116 generates a black character signal from the document.

In the color space compression & undercolor removal & LOG conversion unit 107 which also receives the signal from the selector 106, it is determined in color space compression whether the read image signal is in the reproducible range of the printer. If in the range, the image signal is directly output. If the image signal is not in the range, the signal is corrected to the reproducible range of the printer. Then, undercolor removal processing is executed, and the R, G, and B signals are converted into C, M, and Y signals by LOG conversion.

To correct the timing to the signal generated by the black character determination unit 116, each output signal from the color space compression & undercolor removal & LOG conversion unit 107 is input to a delay 108 to adjust the timing. The two kinds of signals are subjected to moiré removal by a moiré removal unit 109 and scaled in the main scanning direction by a scaling processing unit 110. In a UCR & masking & black character reflecting unit 111, the C, M, and Y signals processed by the scaling processing unit undergo UCR processing to generate C, M, Y, and K signals. The masking processing unit corrects the signals in accordance with the output of the printer. In addition, the determination signal generated by the black character determination unit 116 is fed back to the C, M, Y, and K signals. The signals processed by the UCR & masking & black character reflecting unit 111 is input to a γ correction unit 112 to adjust the density. Then, the signals are subjected to smoothing processing or edge processing by a filter unit 113.

The arrangement of the printer unit will be described with reference to FIG. 2. A photosensitive drum (to be simply referred to as a "photosensitive body" hereinafter) 225 serving as an image carrier can be rotated in the direction of an arrow A by a motor (not shown). Around the photosensitive body 225, a primary charger 221, exposure device 218, black developing unit 219, color developing unit 223, transfer charger 220, and cleaner 222 are arranged.

The black developing unit 219 is a unit for monochrome development and develops a latent image on the photosensitive body 225 by K (black) toner. The color developing unit 223 includes three developing units 223Y, 223M, and 223C for full-color development. The developing units 223Y, 223M, and 223C develop the latent image on the photosensitive body 225 by Y (yellow), M (magenta), and C (cyan) toners, respectively. In developing each color toner, the developing unit 223 of the corresponding color is rotated in the direction of an arrow R by a motor (not shown) and made to abut against the photosensitive body 225.

The toner image of each color developed on the photosensitive body 225 is transferred sequentially to a belt 226 serving as an intermediate transfer body by the transfer charger 220 so that the four color toner images are superimposed. The belt 226 is kept tight on rollers 227, 228, and 229. The roller 227 is connected to a driving source (not shown) and functions as a driving roller to drive the belt 226. The roller 228 functions as a tension roller to adjust the tensile force of the belt 226. The roller 229 functions as the backup roller of a transfer roller 231 serving as a secondary transfer unit. A transfer roller throw-on unit 250 is a driving unit to bring the transfer roller 231 into contact with the belt 226 or separate the transfer roller 231 from the belt 226.

A belt cleaner 232 is provided at a position opposing the roller 227 via the belt 226. A belt cleaner throw-on unit 268 is a driving unit to bring the belt cleaner 232 into contact with the belt 226 or separate the belt cleaner 232 from the belt 226.

Printing sheet media stored in cassettes 240 and 241 and manual feed unit 253 are conveyed to the nip portion, i.e., the butt portion between the secondary transfer unit 231 and the belt 226 by a registration roller 255 and paper feed roller pairs 235, 236, and 237. At this time, the transfer roller throw-on unit 250 is driven in the butt direction so that the secondary transfer unit 231 abuts against the belt 226. The toner image formed on the belt 226 is transferred to the printing sheet medium in this nip portion and thermally fixed by a fixing unit 234. Then, the printing sheet medium is discharged from the apparatus.

To form the image on the printing sheet medium supplied to the secondary transfer unit 231, first, a voltage is applied to the primary charger 221 to uniformly negatively charge the surface of the photosensitive body 225 to a predetermined charging unit potential. Next, exposure is done by the exposure device 218 including a laser scanner unit such that the image portion on the charged photosensitive body 225 is set to a predetermined exposure unit potential, thereby forming a latent image. The exposure device 218 is turned on/off on the basis of the image signal so that a latent image corresponding to the image is formed.

The exposure device 218 has the vibration sensor 267 to measure the vibration during the exposure operation. The vibration sensor 267 need not always be provided in the exposure device 218 and may be provided near the developing unit.

Figure 5:
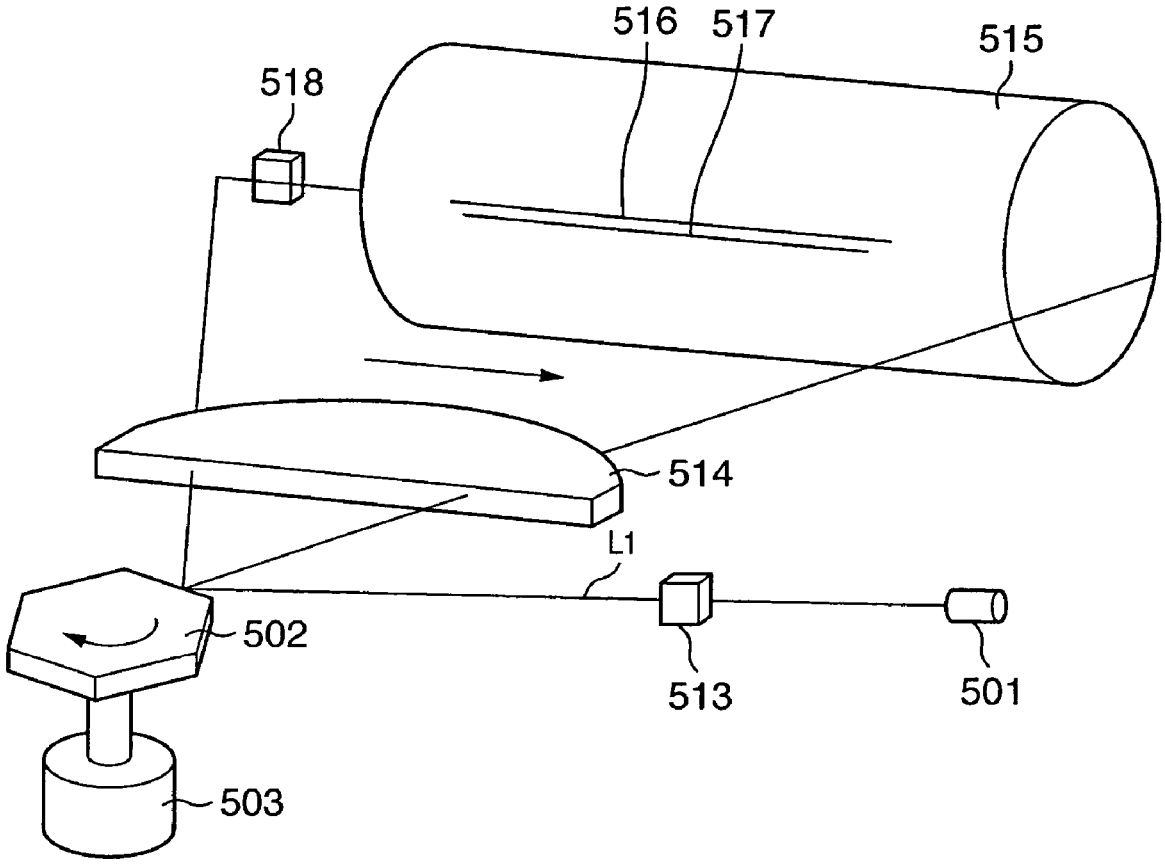
FIG. 5 is a view showing the schematic arrangement of a laser scanner unit.

FIG. 5 is a view showing the schematic arrangement of the laser scanner unit. Light emitted from a laser (light source) 501 changes to a laser beam L1 through a condenser lens 513. To scan a photosensitive drum 515, the laser beam L1 is deflected by a rotary polyhedron 502 which is rotated by a driving motor 503. The deflected laser beam L1 scans the photosensitive drum 515 through an imaging lens 514 so that the surface of the photosensitive drum 515 is scanned at a uniform density (the scanning direction is indicated by the arrow in FIG. 5). To obtain a predetermined image write timing of each scanning line (516 or 517), a sensor 518 (to be referred to as a "BD sensor 518" hereinafter) is provided in the laser scanner unit to detect the incidence of the laser beam L1 on the imaging lens 514 and generate a horizontal sync signal.

A developing bias preset for each color is applied to each of the developing rollers of the black developing unit 219 and color developing unit 223. The latent image is developed by toner when passing through the developing roller and visualized as a toner image. The toner image is transferred to the belt 226 by the transfer unit 220 and further transferred by the secondary transfer unit 231 to the printing sheet medium conveyed from the paper feed unit. After that the printing sheet medium is conveyed to the fixing unit 234 through a fixing convey belt 230. In the fixing unit 234, the toner is charged by prefixing chargers 251 and 252 to prevent any image disturbance by compensating for the attraction of the toner. The toner image is thermally fixed by fixing rollers 233. After that, the convey path is switched to the side of a discharge path 358 so that the printing sheet medium is directly discharged to a discharge tray 242.

In a full-color print mode, the four color toners are superimposed on the belt 226 and then transferred to the printing sheet medium. Toner remaining on the photosensitive body 225 is charged by a precleaner (not shown) for easy cleaning and then removed and collected by the cleaner 222. Finally, the photosensitive body 225 is uniformly discharged to almost 0 V by an antistatic unit (not shown) to prepare for the next image formation cycle.

The image formation timing is controlled on the basis of a predetermined position on the belt 226. The belt 226 is looped around the rollers including the driving roller 227, tension roller 228, and backup roller 229 and is given a predetermined tensile force by the tension roller 228.

A reflection sensor 224 to detect the reference position is arranged between the driving roller 227 and the roller 229. The reflection sensor 224 detects marking of a reflecting tape provided at an end portion of the peripheral surface of the belt 226 and outputs an i-top (image top) signal. In accordance with detection of the i-top signal, the exposure device 218 including the laser scanner starts exposure.

The ratio of the length of the peripheral surface of the photosensitive body 225 to the peripheral length of the belt 226 is an integral ratio represented by 1: n (n is an integer). With this setting, during one rotation of the belt 226, the photosensitive body 225 rotates an integral number of times and exactly returns to the state before the rotation of the belt 226. For this reason, when four colors are to be superimposed on the intermediate transfer belt 226 (the belt rotates four times), any color misregistration by uneven rotation of the photosensitive body 225 can be prevented.

The belt 226 is so long as to form two toner images when the paper sheet is short. Especially, two color images containing four colors superimposed can be formed in only a time to rotate the belt four times so that the productivity is improved.

The image formation apparatus according to the embodiment of the present invention can also form an image on the reverse surface of a printing sheet medium by using a discharge flapper 257, reverse surface path 259, reversing rollers 260, double-sided path convey rollers 262, double-sided path 263, re-feed rollers 264, re-feed sensor 265, and re-feed path 266.

As described above, in the color image formation apparatus, the color developing unit 223 has the three developing units 223Y, 223M, and 223C for full-color development. The color developing unit 223 is rotated in the direction of the arrow R in accordance with the developing timing of each color toner so that the developing unit of the corresponding color abuts against the photosensitive body 225. With this arrangement, developing color switching between Y, M, and C is implemented. This developing color switching is executed simultaneously with the exposure operation of the laser scanner on the photosensitive body 225.

Figures 6A, 6B:
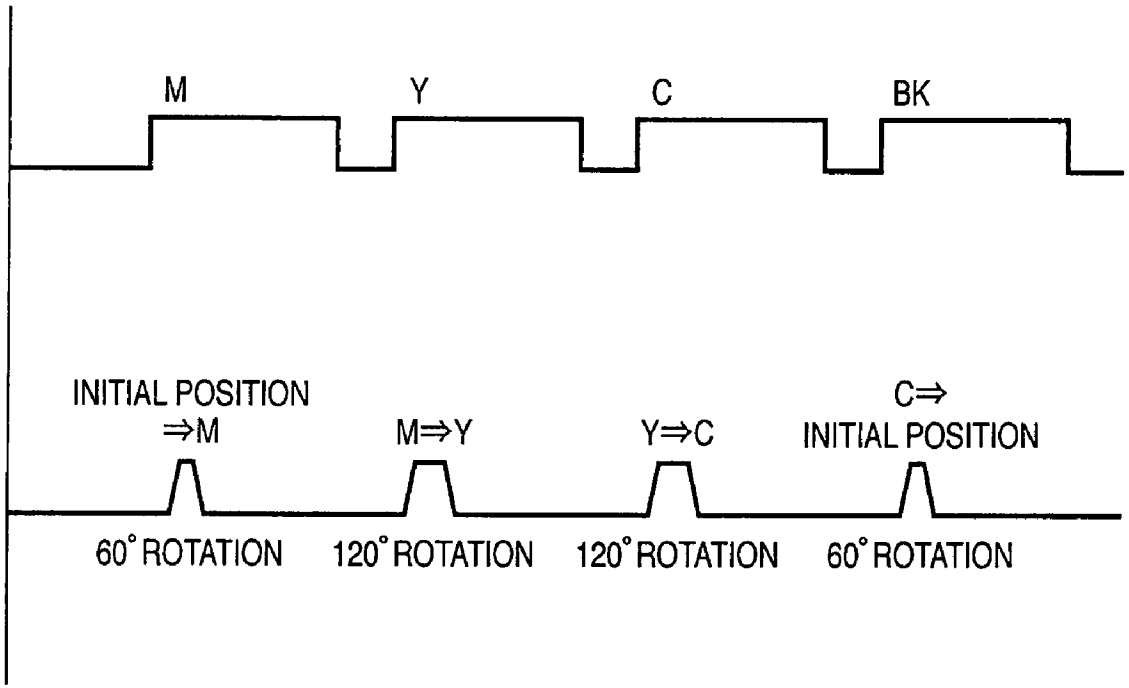
FIGS. 6A and 6B are timing charts showing the relationship between the image exposure timing and the motor driving timing to switch a color developing unit.

FIGS. 6A and 6B are timing charts showing the relationship between the image exposure timing (FIG. 6A) and the motor driving timing to switch the color developing unit 223 (FIG. 6B). Even during the image exposure operation, switching of the color developing unit 223 is executed in parallel. Avoiding the switching operation of the color developing unit 223 during the exposure operation is also possible as an operation sequence. However, from the viewpoint of preventing delay of image formation processing and a decrease in productivity (throughput of the image formation apparatus), there is a restriction that switching of the color developing unit 223 must be executed in parallel between development of the preceding color and that of the succeeding color. That is, switching (rotation) of the color developing unit 223 is necessary during the image exposure operation.

The color developing unit 223 incorporates the developing units and toner bottles of the respective colors. For this reason, the torque of the motor to drive the color developing unit 223 is larger than in the remaining driving units. In addition, there is a restriction that rotation must be done between development of the preceding color and that of the succeeding color, as described above. Hence, vibration which is generated by rotating the color developing unit 223 in the image formation apparatus is dominant in uneven exposure accuracy. More specifically, this vibration influences not a little the relationship to the laser irradiation position on the photosensitive body 225 during the exposure operation and has an adverse effect on the image as uneven exposure accuracy.

Figures 7A, 7B, 7C:
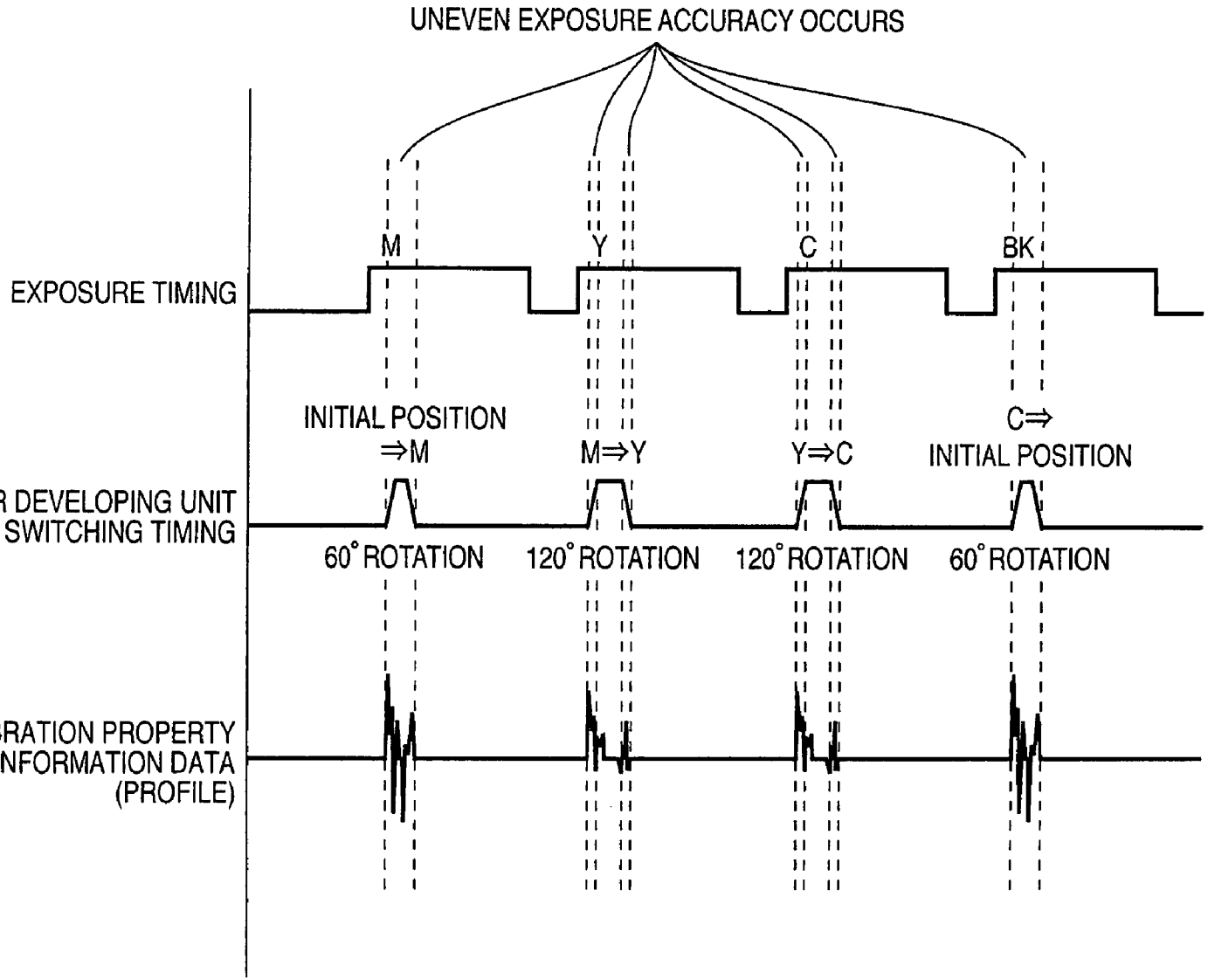
FIGS. 7A to 7C are views schematically showing the effect that vibration caused by the rotation of the color developing unit has on uneven accuracy during the exposure operation.

FIGS. 7A to 7C are views schematically showing the effect that vibration caused by the rotation of the color developing unit 223 has on uneven accuracy during the exposure operation. Exposure is done in the order of M, Y, C, and BK (FIG. 7A). In parallel to the exposure sequence, the color developing unit 223 is rotated by a predetermined rotation amount (60°, 120°, 120°, and 60°) for each color (FIG. 7B). The control unit 200 measures the profile of vibration generated in the exposure operation in advance by using the vibration sensor 267 (FIG. 7C) and stores the profile in the memory 303. In operation based on the same exposure sequence, correction is executed by using the already measured and stored profile to cancel the influence of vibration during the exposure operation. Laser irradiation is thus controlled, thereby suppressing occurrence of uneven accuracy. In regions indicated by broken lines, the peaks of the waveform of the profile become large, and uneven exposure occurs.

If large vibration is expected by referring to the profile, the control unit 200 can alter image data as the exposure target by adjusting the resolution in advance such that the image data is rarely influenced by the vibration in correction of uneven accuracy for the exposure operation. With this processing, any decrease in quality of the output image can be prevented.

The above-described profile is directly influenced by the operation of the movable members during the exposure operation. For example, M, Y, C, and K have different profiles depending on the relationship between the M, Y, C, and K exposure operations and the rotation timing of the color developing unit 223. Hence, when the operation of the movable members (including the color developing unit 223) changes during the exposure operation, no sufficient correction can be done by using the same profile as control data.

In this embodiment, the influence of uneven accuracy on the exposure operation has been described by exemplifying rotation of the color developing unit 223 which is supposed to be most dominant in the uneven accuracy for the exposure operation. However, the uneven accuracy may be caused not only by the influence of the color developing unit 223 but also that of vibration components generated by driving various rollers to convey a printing sheet medium.

The control unit 200 can measure profiles for one exposure operation in advance in accordance with conditions related to the image formation sequence, including the developing colors, paper feed stages, paper sizes, and single- and double-sided printing modes, and store the measured profiles in the memory 303. In accordance with the operation of the image formation apparatus, the control unit 200 can execute correction by referring to the profiles stored in the memory 303 to cancel the influence of vibration during the exposure operation, thereby controlling laser irradiation.

FIG. 8A is a view showing a matrix of profiles necessary as correction data for the exposure operation in correspondence with the developing colors (M, Y, C, and K), paper feed stages (cassettes 1 and 2), paper sizes (large and small), and single- and double-sided printing modes. Different profiles are set in correspondence with the image formation sequences. The profiles arrayed in a matrix will be referred to as a profile matrix hereinafter.

The individual profiles corresponding to the image formation sequences are also influenced by a status change over time. For example, in the exposure operation of each color, the weight balance of the rotation operation of the color developing unit 223 changes depending on the remaining amounts of the respective color toners incorporated in the color developing unit. For this reason, the vibration property generated in accordance with the remaining amounts of the color toners in the image formation operation can also change. It is almost impossible to generate profiles in advance in consideration of all these points. Even when profiles can be generated by roughly classifying situations, the memory 303 to store the profiles must have a large capacity.

Processing of correcting uneven exposure by more effectively updating or generating a profile while minimizing the capacity of the memory 303 necessary for storing the profiles will be described in detail with reference to FIG. 9 to FIGS. 11A to 11C.

Figure 9:
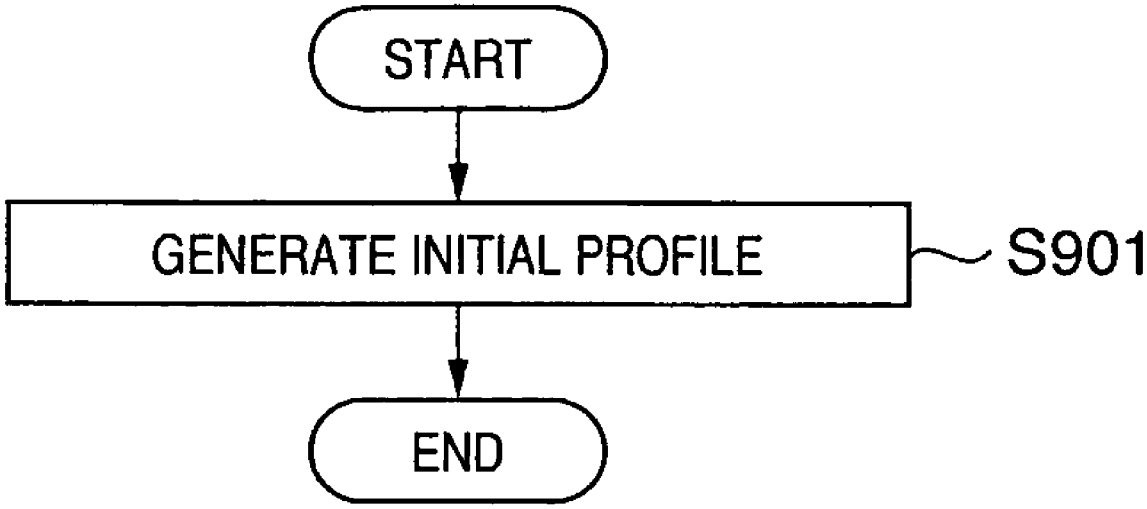
FIG. 9 is a flowchart for explaining profile initialization processing.

Profile initialization processing will be described in detail with reference to the flowchart shown in FIG. 9. In step S901, a basic profile for each image formation sequence is measured in advance. This processing is done to create the initial value of the profile matrix shown in FIG. 8A or 8B and needs to be executed only once in shipping the image formation apparatus from the factory or installing the image formation apparatus. Initial value creation can also be done when total setting of the image formation apparatus needs to be changed. Alternatively, a profile measured when an image formation sequence is executed for the first time may be set as an initial value. Processing related to initial value setting is executed under the control of the control unit 200.

The processing in step S901 is strictly executed to measure the vibration property of the movable members. Hence, it is only necessary that the individual movable members operate in accordance with the actual sequence. Actual printing sheet medium feeding or image formation operation need not be executed to obtain the initial value.

The flow of new profile create/profile update processing executed by the control unit 200 in parallel to the actual image formation operation will be described with reference to the flowchart shown in FIG. 10.

In step S1001, a profile for an image formation sequence is selected before the actual image formation operation. Since the exposure operation must be corrected by using different profiles for the respective colors, as described above, four profiles are selected in correspondence with the exposure operations of M, Y, C, and K. For example, when a sequence of cassette 1/double-sided/small size is selected, four profiles, i.e., profile(M)31, profile(Y)31, profile(C)31, and profile(K)31 are selected in the profile matrix shown in FIG. 8A.

Depending on the conditions of the color and paper feed cassette in one image formation sequence, e.g., in a sequence of cassette 3/single-sided/large size is selected for exposure of M color, as shown in FIG. 8B, the control unit 200 can also register a plurality of profiles such as profile(M)51-1, profile (M)51-2, and profile(M)51-3. In FIG. 8B, the maximum number of registered profiles is 3. However, the present invention is not limited to this as long as a plurality of profiles corresponding to an operation sequence can be registered to the maximum, and a profile most appropriate for the operation sequence can be selected, at the time of correction, from the plurality of registered profiles by referring to them.

When a plurality of profiles are registered, as shown in FIG. 8B, the control unit 200 can determine the date/time of generation/update of each profile on the basis of the update date/time information and preferentially select a latest generated/updated profile.

Figure 10:
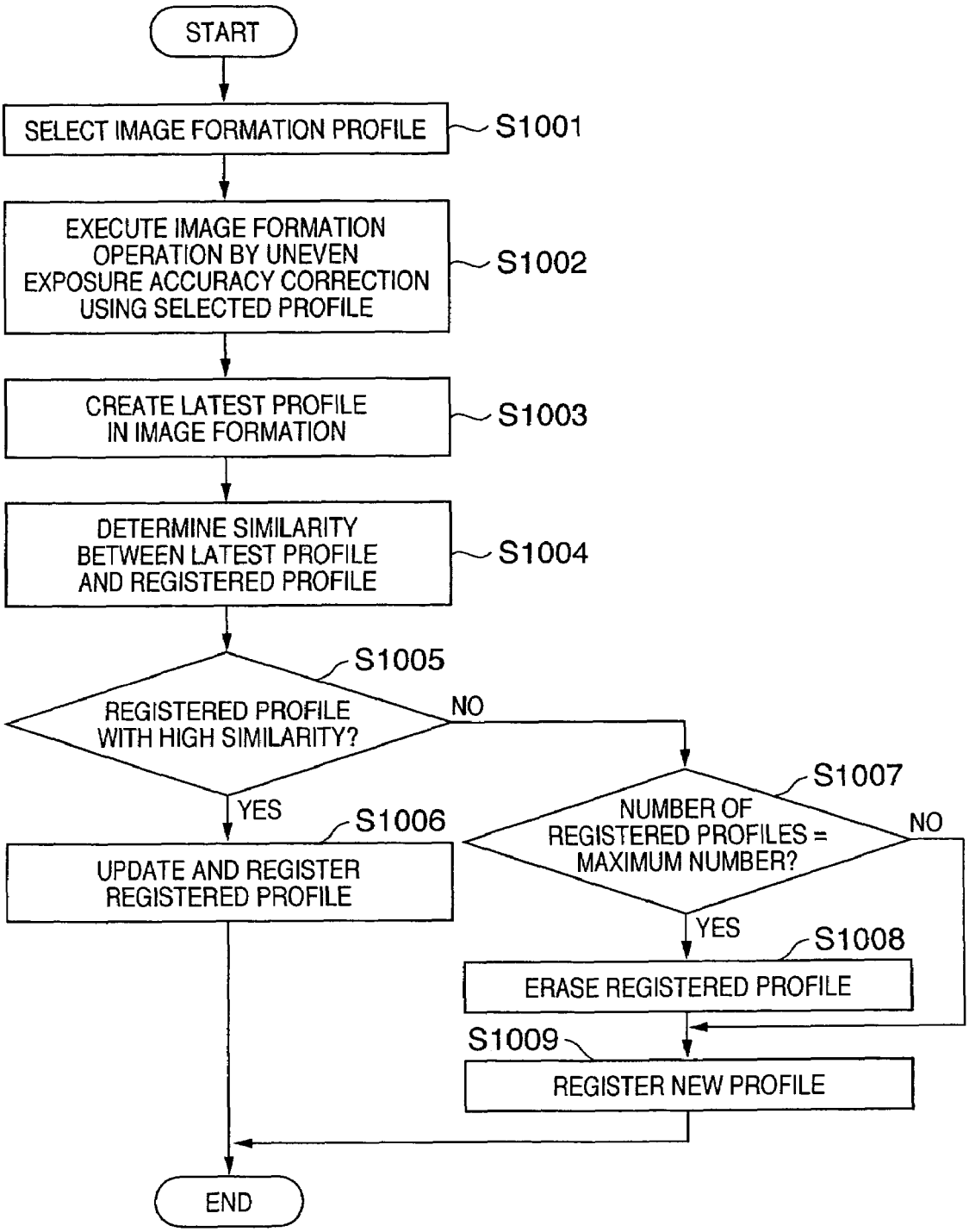
FIG. 10 is a flowchart for explaining the flow of new profile create/profile update processing.
Figure 11A:
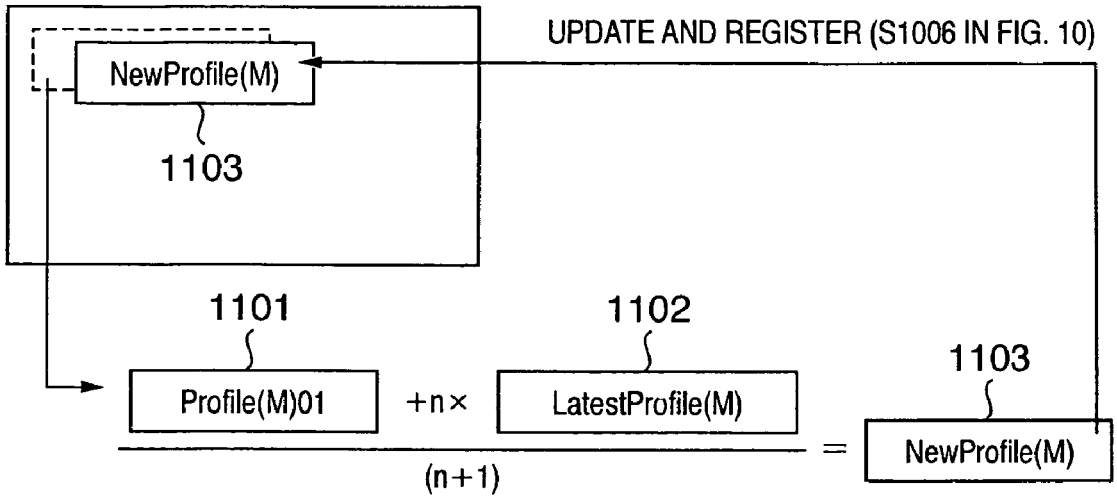
FIGS. 11A to 11C are views for explaining processing related to update/erase of a registered profile and new registration.
Figure 11B:
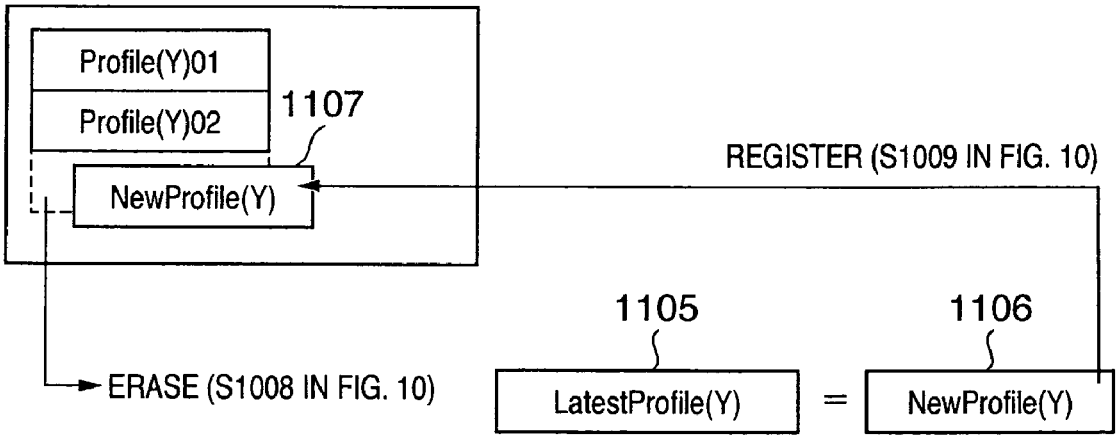
Figure 11C:
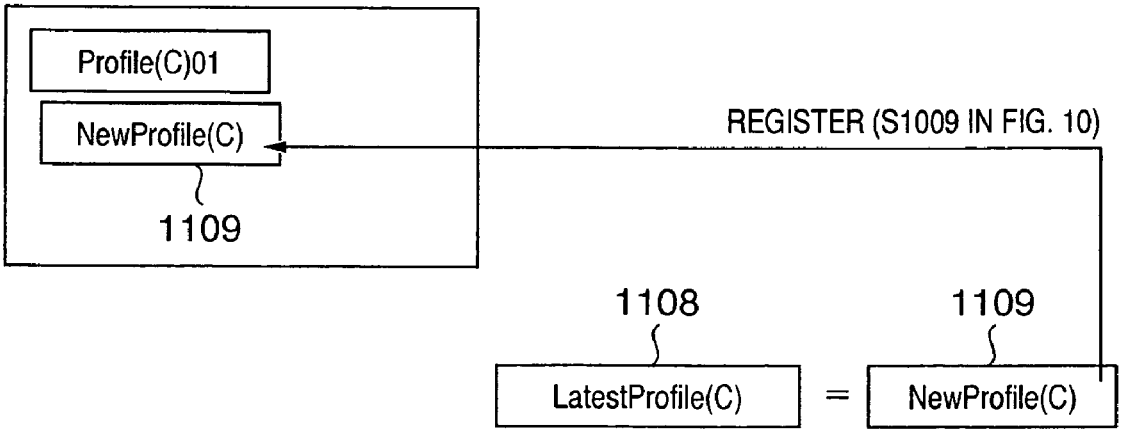

Referring back to the flowchart in FIG. 10, the actual image formation operation is executed while correcting uneven exposure accuracy by using the selected profile in step S1002. At this time, the vibration property is measured simultaneously by using the vibration sensor 267 for the purpose of updating the profiles registered in the memory 303.

In step S1003, the latest profile in image formation is created on the basis of the vibration property measured in step S1002. In step S1004, the similarity between the latest profile created in step S1003 and one or a plurality of profiles (for example, when three profiles are registered, as shown in FIG. 8B, the similarity is determined by sequentially selecting the three profiles) already registered in the profile matrix (FIG. 8A) in the memory 303 is determined. The similarity determination in step S1004 is done in accordance with an algorithm shown in FIG. 12.

In step S1201, each of the latest profile and registered profiles is moving-averaged for a predetermined period to remove periodic noise. A variance average D1diff is obtained from the result.

In step S1202, the variance value between the latest profile and each of the registered profiles is calculated to remove the offset value. A variance average D2diff is obtained from the result.

In step S1203, the latest profile and registered profiles are binarized on the basis of a predetermined threshold, and only the peak value distribution is extracted. A variance average D3diff is obtained from the result.

The above-described three steps are based on a general feature extraction method as statistical processing. If all the values D1diff to D3diff obtained in the steps are equal to or smaller than a predetermined reference value (YES in step S1204), the control unit 200 determines that the similarity between the latest profile and the registered profile is high (S1205). In this case, in steps S1204 and S1205, the control unit 200 handles the plurality of statistical calculated values as feature extraction data, executes pattern recognition processing by combining them (determines whether the feature extraction data satisfies the reference value), thereby determining the similarity.

On the other hand, if the condition that all the values D1diff to D3diff are equal to or smaller than the predetermined reference value is not satisfied in step S1204, the control unit 200 determines that the similarity between the latest profile and the registered profile is low (S1206) and ends the processing.

Referring back to FIG. 10, it is determined in step S1005 whether a registered profile determined to have high similarity in step S1004 is present. If a registered profile determined to have high similarity is present (YES in step S1005), the processing advances to step S1006.

If no registered profile determined to have high similarity is present in step S1005 (NO in step S1005), the processing advances to step S1007.

In step S1006, arithmetic processing between the latest profile created in step S1003 and the registered profile determined to have high similarity in step S1004 is executed. The registered profile is updated on the basis of the result. Update of a registered profile will be described with reference to FIG. 11A. Reference numeral 1101 denotes a profile which is arrayed in the profile matrix and registered in the memory 303; and 1102, a latest profile (Latest Profile(M)) which is newly obtained. The control unit 200 executes weighted averaging with a weight of n times for the latest predicted profile 1102 to obtain a new profile (New Profile(M)) 1103 to be registered newly. The profile 1101 registered in the memory 303 as arrayed data in the profile matrix is updated by the new profile (New Profile(M)) 1103 and registered.

Update/registration may be executed either automatically or after display of update/registration and confirmation or instruction by the user including the administrator of the apparatus.

In step S1006, update/registration is executed following the weighted averaging process. However, profile 1101 can be replaced by the new profile 1103, which is the latest profile 1102 registered directly without being subjected to the weighted averaging process. Furthermore, it is possible to assign multiple standard values determined in S1005 and execute termination step without the update/registration of step S1006 if the similarity is high, or execute the process of step S1007 if the similarity is low.

When it is determined that the latest profile created in step S1003 has low similarity to all of the already registered profiles, the profile is registered as a new profile without updating any one of the registered profiles. In step S1007, the control unit 200 determines whether the number of registered profiles corresponding to a designated image formation sequence (e.g., the sequence of cassette 3/single-sided/large size for exposure of M color, as shown in FIG. 8B) has reached the maximum registrable number.

If it is determined in step S1007 that the number of registered profiles has reached the maximum registrable number (YES in step S1007), the processing advances to step S1008 to erase a profile with the oldest update time from the registered profiles (S1008). The processing advances to step S1009 to register a latest profile (Latest Profile(Y)) 1105 as a new profile (New Profile(Y)) 1106.

Erase may be executed either automatically or after display of erase and confirmation or instruction by the user including the Administrator of the apparatus.

If it is determined in step S1007 that the number of registered profiles has not reached the maximum registrable number (NO in step S1007), the processing advances to step S1009 to register a latest profile (Latest Profile(C)) 1108 as a new profile (New Profile(C)) 1109.

Registration may be executed either automatically or after display of registration and confirmation or instruction by the user including the administrator of the apparatus.

With the above-described processing, image formation can be executed while correcting uneven exposure by the latest profile. In addition, the profiles can be updated as needed in accordance with the status change, and the memory capacity necessary for profile registration is limited to an appropriate predetermined amount.

According to this embodiment, on the basis of similarity determination between the registered profile and the latest profile, update or erase of the registered profile or new registration of the latest profile is done under the limitation of the memory capacity. With this arrangement, uneven exposure accuracy can be corrected by using a profile adaptive to the vibration property of a movable member which varies over time while efficiently using the memory capacity.

According to the present embodiment, registered profiles are updated, deleted and registered based on the similarity determination of the registered profile and the latest profile. However, it is acceptable to execute processes of from step S1003 to step S1006. In other words, by simply updating the registered profile with the latest file in each case, without determining the similarity of the registered profile and the latest profile, nearly equal effectiveness can be achieved as what is mentioned above.

Modification to First Embodiment

In the uneven exposure correction method of this embodiment, if large vibration is expected by referring to the profile, image data as the exposure target is altered by adjusting the resolution in advance such that the image data is rarely influenced by the vibration, thereby minimizing the decrease in quality of the output image caused by the vibration in the switching operation of the color developing unit 223. Any other general uneven exposure correction method may be employed.

For example, as the uneven exposure correction method, a reaction to a vibration component may be obtained by using a force sensor, and the vibration itself may be canceled on the basis of the obtained reaction. In this case, a profile obtained by measuring vibration is based on the vibration property after correction. Hence, no sufficient correction effect can be obtained by directly using the profile obtained by measurement as next correction data.

In this case, it is preferable to cause the control unit 200 to calculate the sum of a profile (1) to be used as correction data and a profile (2) to be measured in driving by the profile (1) and use the sum of the profiles ((1)+(2)) as correction data of the next driving. The profile (2) corrects a vibration component which was not corrected by the profile (1) based on the preceding measurement result. When the two profiles are combined, effective correction can be done even in canceling a physical property such as a reaction.

In this embodiment, the influence of vibration of the laser polygon scanner has been exemplified as a cause for uneven exposure, and a profile creation/update method serving as a correction means has been described in detail. The uneven exposure is not always be caused by the vibration of the laser polygon scanner. Even in an image formation apparatus using no laser polygon, uneven exposure may be caused by the vibration of a movable member. Even when the exposure method or the cause for uneven exposure changes, the uneven exposure can be corrected by providing the vibration sensor 267 near the vibration source and creating or updating a profile for a movable part.

In this embodiment, as image formation conditions which are supposed to particularly influence uneven exposure, four conditions: developing color, paper feed stage, paper size, and single- and double-sided mode have been exemplified, and the image formation sequence of registering a profile has been described. However, profiles may be classified more finely by adding other operation conditions in executing image formation processing.

If a single image formation sequence has a plurality of profiles with completely different tendencies in the process of updating a profile, the control unit 200 can add some operation condition as a new classification condition to further correct the profile. Even in this case, a relatively large capacity must be prepared for the memory 303 by predicting the increase amount.

Details of latest profile creation from step S1003 can be set by the user including the administrator of the apparatus in a service mode or user mode. More specifically, in the service mode or user mode, the user is caused to set the profile update timing for every image formed, every JOB, or every designated number of sheets, only in a designated image formation mode or only in a specific state such as an image adjustment mode or developing unit exchange mode. These settings can be used optimally by setting a single mode or combining the modes in accordance with the use situation of the installed apparatus. For example, if the image formation mode frequency changes, the update timing is preferably set for every image formed or every JOB. If the image formation mode to be used rarely changes, the frequently used image formation mode is set. In this case, the accuracy of a profile increases, the profile can be updated as needed, and the memory capacity can effectively be used.

Even in erasing the oldest registered profile in step S1008, the profile to be erased may be selected and designated in the service mode or user mode or in actual erase mode.

More specifically, the user including the administrator of the apparatus is caused to designate whether to erase an old profile, a designated profile, or a profile with low use frequency. As a result, careless erase of a profile can be prevented, and only effective profiles are updated.

Figure 12:
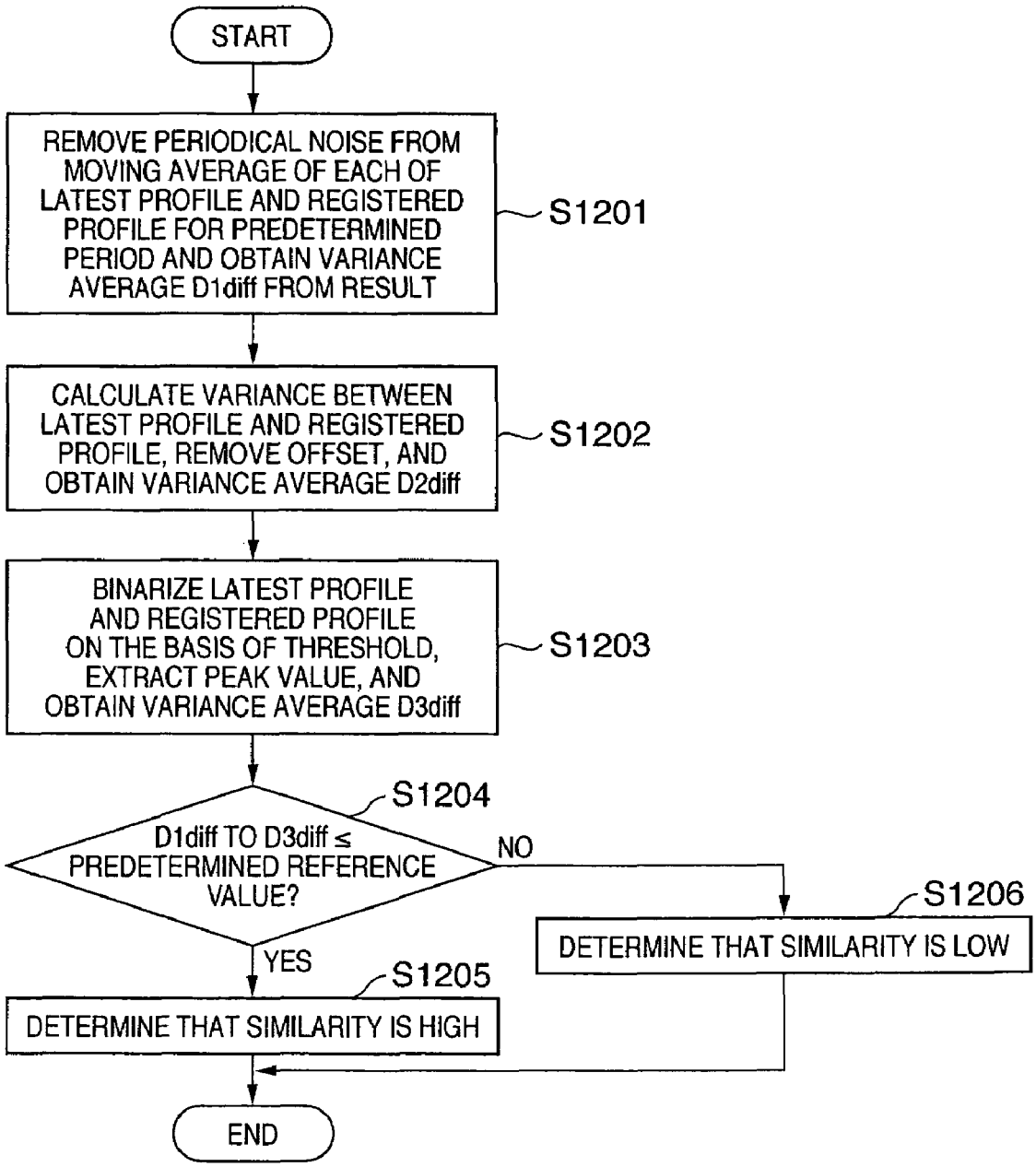
FIG. 12 is a flowchart for explaining the flow of profile similarity determination processing.

In determinative calculation of the similarity of profiles, three calculation methods described in FIG. 12, i.e., three feature extraction methods are used: (1) method of obtaining a variance average from a moving average of each profile (S1201), (2) method of obtaining a variance value by removing the offset of each profile (S1202), and (3) method of obtaining a variance average by extracting the peak value of each profile. However, the feature extraction method is not limited to these methods. Determination may be done on the basis of any other feature extraction method based on a general statistical method.

As has been described above, according to the embodiment of the present invention, on the basis of similarity determination between the registered profile and the latest profile, update or erase of the registered profile or new registration of the latest profile is done under the limitation of the memory capacity. With this arrangement, uneven exposure accuracy can be corrected by using a profile adaptive to the vibration property of a movable member which varies over time while efficiently using the memory capacity.

In addition, in updating, erasing, or newly registering a profile, a message representing it can be displayed to confirm the profile update situation.

Second Embodiment

The object of the present invention is achieved even by supplying a storage medium which records software program codes to implement the functions of the above-described embodiment to the control unit of an image formation apparatus and causing the computer (or CPU or MPU) of the apparatus to read out and execute the program codes stored in the storage medium. The program codes need not always be stored in a client computer but may be stored in a computer serving as, e.g., a server.

In this case, the program codes read out from the storage medium implement the functions of the above-described embodiment by themselves, and the storage medium which stores the program codes constitutes the present invention.

As the storage medium to supply the program codes, for example, a flexible disk, hard disk, optical disk, magnetooptical disk, CD-ROM, CD-R, DVD, magnetic tape, nonvolatile memory card, or ROM can be used.

The functions of the above-described embodiment are implemented not only when the readout program codes are executed by the computer but also when the operating system (OS) running on the computer performs part or all of actual processing on the basis of the instructions of the program codes.

The functions of the above-described embodiment are also implemented when the program codes read out from the storage medium are written in the memory of a function expansion board inserted into the computer or a function expansion unit connected to the computer, and the CPU of the function expansion board or function expansion unit performs part or all of actual processing on the basis of the instructions of the program codes.

As many apparently widely different embodiments of the present invention can be made without departing from the spirit and scope thereof, it is to be understood that the invention is not limited to the specific embodiments thereof except as defined in the claims.

CLAIM OF PRIORITY

This application claims priority from Japanese Patent Application No. 2004-355884 filed on Dec. 8, 2004, which is hereby incorporated by reference herein.

What is claimed is:

1. An image formation apparatus for correcting uneven image formation on the basis of vibration property information corresponding to an operation sequence in image formation, comprising:

a storage device adapted to store vibration property information corresponding to a plurality of operation sequences;

a correction device adapted to correct the uneven image formation on the basis of vibration property information corresponding to an operation sequence selected from said storage device;

a measurement device adapted to measure vibration property information generated by driving of a movable member when the selected operation sequence is being executed while the uneven image formation is corrected by said correction device; and a memory control device adapted to rewrite-control the vibration property information selected from said storage device in accordance with a measurement result of said measurement device.

2. An image formation apparatus for correcting uneven image formation on the basis of vibration property information corresponding to an operation sequence in image formation, comprising:

a storage device adapted to store vibration property information corresponding to a plurality of operation sequences;

a correction device adapted to correct the uneven image formation on the basis of vibration property information corresponding to an operation sequence selected from said storage device;

a measurement device adapted to measure vibration property information generated by driving of a movable member when the selected operation sequence is being executed while the uneven image formation is corrected by said correction device;

a determination device adapted to determine whether the vibration property information measured by said measurement device is similar to the vibration property information selected from said storage device; and a memory control device adapted to rewrite-control the vibration property information stored in said storage device in accordance with a determination result of said determination device.

3. The apparatus according to claim 2, wherein said correction device corrects uneven exposure accuracy in image formation.

4. The apparatus according to claim 2, wherein said determination device obtains feature extraction data on the basis of the measured vibration property information and the selected vibration property information and determines, on the basis of whether the feature extraction data satisfies a reference value, whether the vibration property information are similar.

5. The apparatus according to claim 2, wherein when a plurality of selectable vibration property information are registered in said storage device, said determination device sequentially selects the plurality of selectable vibration property information and determines whether each vibration property information is similar to the measured vibration property information.

6. The apparatus according to claim 2, wherein said memory control device controls updating of the measured vibration property information based on a similarity of the vibration property information.

7. The apparatus according to claim 6, wherein when said determination device determines that the vibration property information are similar, said memory control device executes weighted averaging by weighting the selected vibration property information and the measured vibration property information to 1:n (n is a natural number) and updates the selected vibration property information on the basis of vibration property information calculated by the averaging.

8. The apparatus according to claim 2, wherein when said determination device determines that the vibration property information are not similar, said memory control device determines whether the number of the vibration property information registered in said storage device have reached a maximum registrable number, and if the number has not reached the maximum number, registers the measured vibration property information in said storage device.

9. The apparatus according to claim 8, wherein if the number of the vibration property information registered in said storage device has reached the maximum number, said memory control device erases the vibration property information with an oldest update time and registers the measured vibration property information in said storage device.

10. An image formation method of an image formation apparatus for correcting uneven image formation on the basis of vibration property information corresponding to an operation sequence in image formation, comprising:

a storage step of storing vibration property information corresponding to a plurality of operation sequences in a storage device;

a correction step of correcting the uneven image formation on the basis of vibration property information corresponding to an operation sequence selected from the storage device;

a measurement step of measuring vibration property information generated by driving of a movable member when the selected operation sequence is being executed while the uneven image formation is corrected in the correction step; and a memory control step of rewrite-controlling the vibration property information selected from the storage device in accordance with a measurement result of the measurement step.

11. An image formation method of an image formation apparatus for correcting uneven image formation on the basis of vibration property information corresponding to an operation sequence in image formation, comprising:

a storage step of storing vibration property information corresponding to a plurality of operation sequences in a storage device;

a correction step of correcting the uneven image formation on the basis of vibration property information corresponding to an operation sequence selected from the storage device;

a measurement step of measuring vibration property information generated by driving of a movable member when the selected operation sequence is being executed while the uneven image formation is corrected in the correction step;

a determination step of determining whether the measured vibration property information is similar to the vibration property information selected from the storage device; and a memory control step of rewrite-controlling the vibration property information stored in the storage device in accordance with a determination result in the determination step.

12. An image formation apparatus for correcting uneven image formation on the basis of vibration property information corresponding to an operation sequence in image formation, comprising:

a storage device adapted to store vibration property information corresponding to a plurality of operation sequences;

a correction device adapted to correct the uneven image formation on the basis of vibration property information corresponding to an operation sequence selected from said storage device;

a measurement device adapted to measure vibration property information generated by driving a movable member when the selected operation sequence is being executed while correcting the uneven image formation on the basis of said correction device;

a determination device adapted to determine whether the vibration property information measured by said measurement device is similar to the vibration property information selected from said storage device; and a display device adapted to execute display related rewrite control of the vibration property information stored in said storage device in accordance with a determination result of said determination device.

13. An image formation method of an image formation apparatus for correcting uneven image formation on the basis of vibration property information corresponding to an operation sequence in image formation, comprising:

a storage step of storing vibration property information corresponding to a plurality of operation sequences in a storage device;

a correction step of correcting the uneven image formation on the basis of vibration property information corresponding to an operation sequence selected from the storage device;

a measurement step of measuring vibration property information generated by driving a movable member when the selected operation sequence is being executed while correcting the uneven image formation on the basis of the correction step;

a determination step of determining whether the measured vibration property information is similar to the vibration property information selected from the storage device; and a display step of executing display related to rewrite control of the vibration property information stored in the storage device in accordance with a determination result in the determination step.

14. An image formation apparatus for correcting uneven image formation on the basis of vibration property information corresponding to an operation sequence in image formation, comprising:

a storage device adapted to store vibration property information corresponding to a plurality of operation sequences;

a correction device adapted to correct the uneven image formation on the basis of vibration property information corresponding to an operation sequence selected from said storage device;

a measurement device adapted to measure vibration property information generated by driving a movable member when the selected operation sequence is being executed while correcting the uneven image formation on the basis of said correction device;

a determination device adapted to determine whether the vibration property information measured by said measurement device is similar to the vibration property information selected from said storage device;

a memory control device adapted to rewrite-control the vibration property information stored in said storage device in accordance with a determination result of said determination device; and a display device adapted to execute display related rewrite control of the vibration property information stored in said storage device.

15. An image formation method of an image formation apparatus for correcting uneven image formation on the basis of vibration property information corresponding to an operation sequence in image formation, comprising:

a storage step of storing vibration property information corresponding to a plurality of operation sequences in a storage device;

a correction step of correcting the uneven image formation on the basis of vibration property information corresponding to an operation sequence selected from the storage device;

a measurement step of measuring vibration property information generated by driving a movable member when the selected operation sequence is being executed while correcting the uneven image formation on the basis of the correction step;

a determination step of determining whether the measured vibration property information is similar to the vibration property information selected from the storage device;

a memory control step of rewrite-controlling the vibration property information stored in the storage device in accordance with a determination result in the determination step; and a display step of executing display related to rewrite control of the vibration property information stored in the storage device.

* * * * *